US005143223A

United States Patent [19]

Herren

[11] Patent Number: 5,143,223

[45] Date of Patent: Sep. 1, 1992

[54] REINFORCED SCREEN RAIL

[76] Inventor: Harold Herren, 802 Main St., Platteville, Colo. 80651

[21] Appl. No.: 788,811

[22] Filed: Nov. 7, 1991

[51] Int. Cl.[5] ..... B07B 1/46

[52] U.S. Cl. ..... 209/405; 209/403; 228/182

[58] Field of Search ..... 209/403–405, 209/400, 399, 401, 319, 931; 29/897.1, 525.1; 228/182

[56] References Cited

U.S. PATENT DOCUMENTS

| | | | |
|---|---|---|---|
| 2,630,225 | 3/1953 | Bye | 209/403 |
| 3,203,548 | 8/1965 | Roubal | 209/405 X |
| 3,718,963 | 3/1973 | Hawkins | 209/405 X |
| 3,870,630 | 3/1975 | Tylinski | 209/403 X |
| 4,380,494 | 4/1983 | Wilson | 209/403 X |
| 4,735,712 | 4/1988 | Herren et al. | 209/403 |
| 5,028,316 | 7/1991 | Herren | 209/403 |

*Primary Examiner*—Donald T. Hajec
*Attorney, Agent, or Firm*—Dean P. Edmundson

[57] ABSTRACT

A reinforced screen rail is described which is useful for retaining a screen in a screendeck. The screen rail includes spaced apertures corresponding to apertures in the screen deck. A metal layer is secured along the length of the screen rail to increase its useful life.

9 Claims, 2 Drawing Sheets

REINFORCED SCREEN RAIL

FIELD OF THE INVENTION

This invention relates to screen decks of the type used for screening crushed rock and gravel to separate it into various segments according to size. More particularly, this invention relates to improved screen rails having extended life.

BACKGROUND OF THE INVENTION

Side rails are commonly used for tensioning and supporting screens in a screen deck. The side rails are removably attached to upright side walls or panels in the deck in a manner such that the rails engage a screen at its side edges and tension the screen in a secure manner.

Multiple vibrating screens are normally used, with a top screen separating the largest size of material, such as sand, gravel, crushed stone and the like with the material which passes through the top screen falling onto an intermediate screen. The intermediate screen separates an intermediate size of material, with the remainder falling through the intermediate screen onto a finer screen, which in turn separates the larger particles of those falling onto it and the smallest size falling through for collection beneath.

Different techniques have been utilized to removably attach the screen rails to the side walls or panels. For example, one very common technique involves the use of bolts or pins which extend through apertures in the screen rails and corresponding apertures in the side walls. A fastener is then used to secure the bolt or pin in place. The bolt or pin head is thus located on the side of screen rail which is exposed to the rock being screened or sorted.

The entire screen deck assembly is then vibrated, usually to produce a slow forward movement and a rapid rearward movement, so that the rock material will move forward with the screen but, due to inertia will permit the screen to move rearwardly under it. As a result, the rock material will work its way forwardly on the respective screen, so that material which does not fall through the screen will be discharged from the front of the respective screen, for collection.

The friction and abrasion resulting from the gravel and rock wearing on the screen rails eventually will wear the screen rails thin. The heads of the bolts used to secure the screen rails to the screen deck also can become worn down because of the abrasion of the gravels and rock moving on the screen in the deck.

Rubber-covered screen rails have been proposed for use in a screen deck, and this type of screen rail does exhibit greater useful life in a screen deck. However, special equipment must be used in order to manufacture such screen rails. Also, the cost of such screen rails is considerably greater than for conventional screen rails.

There has not heretofore been provided screen rails having extended wear life at a low cost.

SUMMARY OF THE PRESENT INVENTION

In accordance with the present invention there is provided a reinforced screen rail for use in a screen deck to tension and retain a screen between two upright side panels. The screen rail includes first and second side surfaces and upper and lower portions. The upper portion is curved in the direction of the first side surface. The lower portion includes a leg projecting in the direction of the first side surface.

The screen rail includes a plurality of spaced apertures therethrough. A metal reinforcement layer extends along the length of the rail and is secured to the second side surface thereof (e.g., by welding).

The reinforcement layer has a thickness in the range of about 0.1–0.25 inch, preferably. The reinforcement layer includes a plurality of openings therethrough corresponding to the spaced apertures in the rail. A plurality of reinforcement members are secured to the opposite side of the rail corresponding to the location of the spaced apertures in the rail. Each reinforcement member includes a hole or opening therethrough corresponding to an aperture in the rail. The reinforcement members serve to protect the rail at the location of the aperture and prevent the rail from cracking or collapsing at the location of the apertures.

The life of the reinforced screen rails of this invention is significantly longer than that of conventional screen rails. The life of the reinforced rails compares favorably to that of screen rails which have expensive rubber layers thereon.

Other advantages of the present invention will be apparent from the following detailed description.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
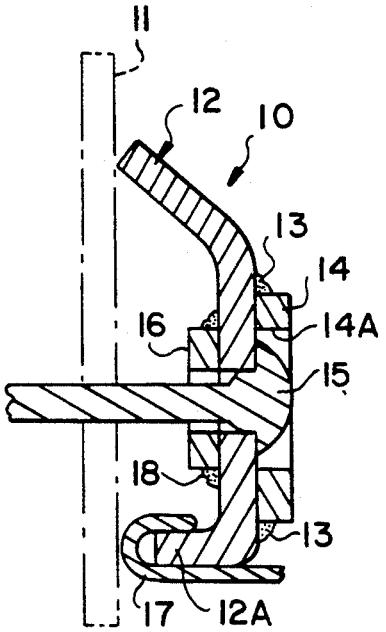
FIG. 1 is a cross-sectional view illustrating one embodiment of screen rail of this invention.
Figure 3:
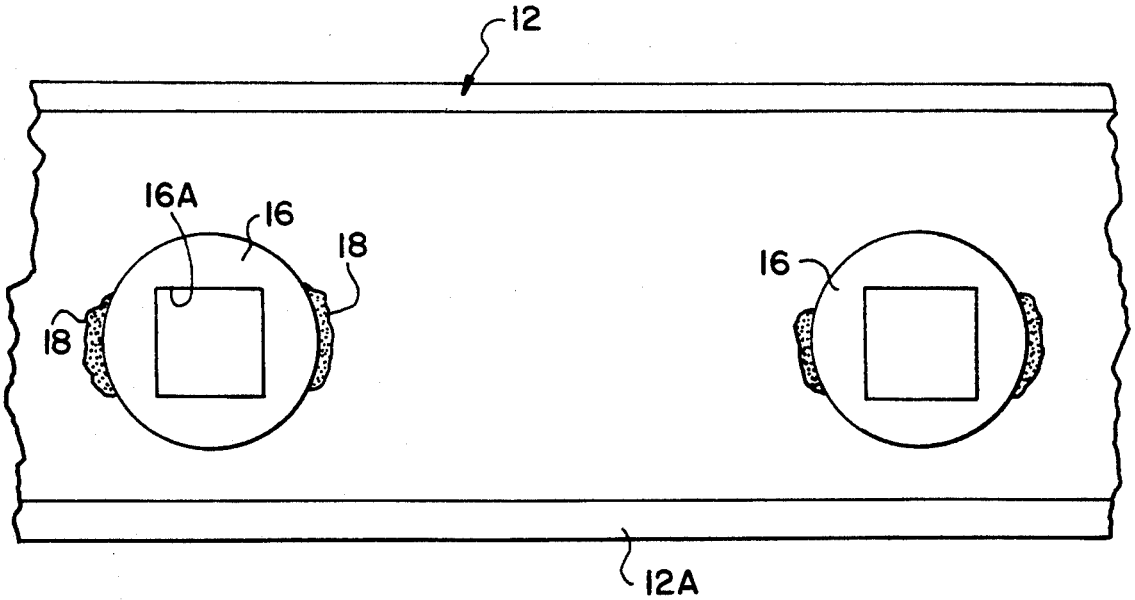
FIG. 3 is a side elevational view of the screen rail of FIG. 1.
Figure 4:
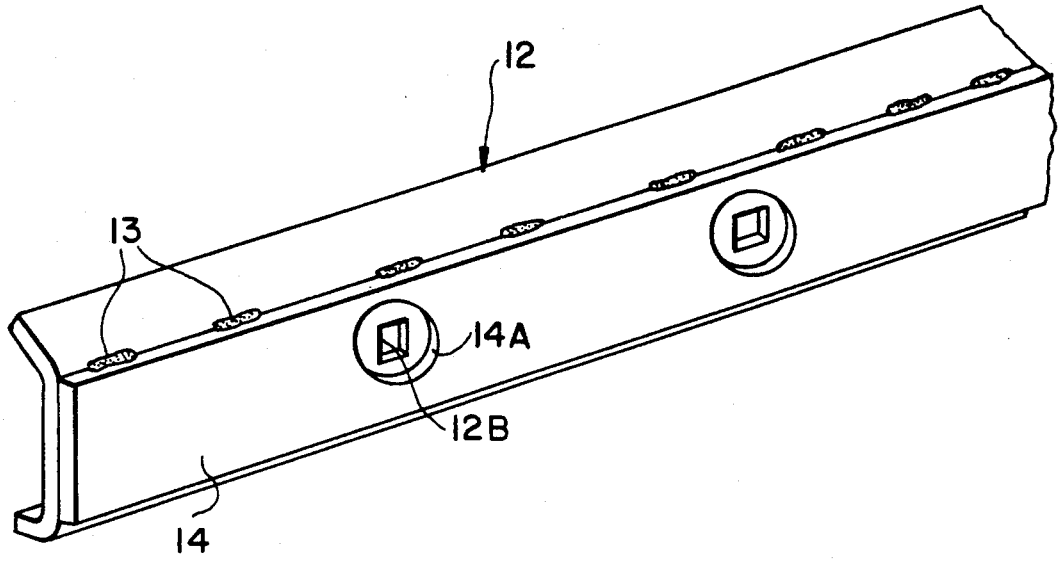
FIG. 4 is a perspective view of the embodiment of screen rail shown in FIG. 1.

In FIGS. 1, 3 and 4 there is illustrated one embodiment of improved screen rail 10 of this invention. The screen rail includes a lower edge 12A which is adapted to engage a hook 17 on the side edge of a screen in a screen deck. Bolt 15 extends through an aperture in the screen rail and a corresponding aperture in the side wall 11 of the screen deck in a manner such that the screen rail supports the screen in the deck and holds it firmly and securely in place.

Along one side of the screen rail there is welded a reinforcing metal layer 14 (e.g., steel). Spot welds 13 secure the layer 14 to the screen rail. The layer 14 has a thickness in the range of about 0.1–0.25 inch and it extends along the full length of the screen rail.

The layer 14 includes an aperture 14A corresponding to the location of each existing aperture in the screen rail. The aperture 14A is sufficiently large to receive the head of bolt 15, as illustrated.

On the opposite side of the screen rail there is secured a reinforcing section 16 surrounding each aperture in the screen rail. It can be secured in place by welds 18. The thickness of section 16 is in the range of about 0.1–0.25 inch. Preferably the section 16 is the portion which is removed from the reinforcing layer 14 to form aperture 14A. Section 16 reinforces the screen rail in the area around the aperture 12B for receiving bolt 15.

The reinforced screen rail 10 has a much greater useful life than that experienced by a conventional screen rail. Furthermore, the presence of the reinforcing section 16 prevents the screen rail from cracking or breaking in the area adjacent to the aperture 12B for receiving bolt 15.

Figure 2:
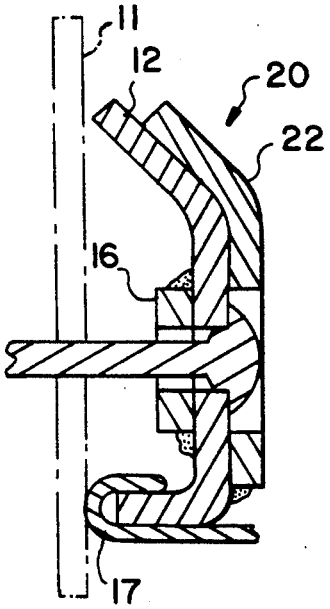
FIG. 2 is a cross-sectional view illustrating another embodiment of screen rail of the invention.

FIG. 2 illustrates another embodiment 20 of reinforced screen rail of the invention. In this embodiment the reinforcing layer 22 covers the vertical face of screen rail 12 and also extends upwardly over substantially the whole area of the sloping portion of the screen rail. The thickness of the reinforcing layer 22 is generally in the range of about 0.1 to 0.25 inch. Layer 22 is secured to the screen rail by spot welds.

Figure 5:
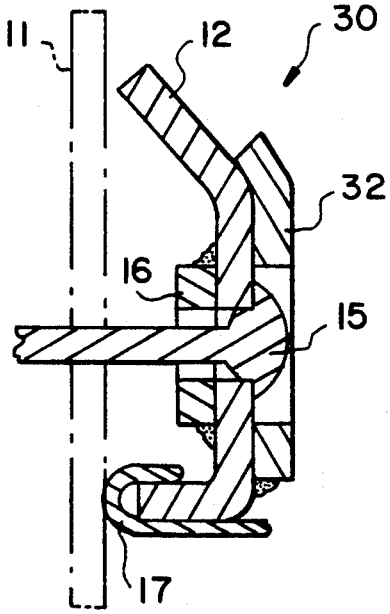
FIG. 5 is a cross-sectional view of another embodiment of screen rail of the invention.

FIG. 5 shows another embodiment 30 of reinforced screen rail of the invention. In this embodiment the reinforcing layer 32 extends over the vertical face of the screen rail and also extends partially over the sloping upper face of the screen rail. The layer 32 is secured in place by welding.

The length of the screen rails may vary, e.g., from about 2 feet to 10 feet or more. The reinforcing layer extends over the full length of the screen rail. The cross-sectional configuration of the screen rail may also vary. The techniques of the present invention are fully applicable to any shape of screen rail selected.

The reinforcing layer can be provided in any desired thickness (e.g., from about 0.1 to 1 inch, if desired). When the reinforcing layer becomes worn, it can easily be detached from the screen rail and then replaced with a new reinforcing layer (which is spot welded to the screen rail). Thus, the original screen rail can be used over and over by simply replacing the reinforcing layer when necessary. The reinforcing layer can be provided in any desired configuration to conform to the shape of any existing screen rail.

Use of the reinforcing techniques described herein enables one to continue using the same bolts as currently used to secure the screen rail to the screen deck. Also, the existing screen rail will continue to engage the hooks on the sides of the existing screens used in conventional screen decks. Thus, the reinforcing techniques described herein are applicable to any type of screen rail without interfering with the normal use of such screen rail.

Other variants are possible without departing from the scope of this invention.

What is claimed is:

1. A reinforced screen rail for use in a screen deck to tension and retain a screen between two upright side panels; wherein said screen rail includes first and second side surfaces and upper and lower portions; wherein said upper portion is curved in the direction of said first side surface; wherein said lower portion includes a leg projecting in the direction of said first side surface; wherein said screen rail includes a plurality of spaced apertures therethrough for receipt of a bolt means having a head; wherein the improvement comprises a metal reinforcement layer extending substantially along the entire length of said screen rail and being secured to said second side surface thereof; wherein said reinforcement member includes a plurality of openings therethrough corresponding to said spaced apertures and sized to receive the head of the bolt means; and further comprising a reinforcement member surrounding each of said openings and being secured to said first side surface of said screen rail.

2. A screen rail in accordance with claim 1, wherein said reinforcement layer has a uniform thickness in the range of about 0.1–0.25 inch.

3. A screen rail in accordance with claim 1, wherein each said reinforcement member comprises a disk having a thickness in the range of about 0.1 to 0.25 inch; and wherein each said disk includes a hole therethrough corresponding to one of said openings.

4. A screen rail in accordance with claim 1, wherein said rail has a length in the range of about 4 to 10 feet.

5. A screen rail in accordance with claim 3, wherein each said opening and each said hole are square.

6. A screen rail in accordance with claim 1, wherein said reinforcement layer is welded to said second side surface of said rail.

7. A method for reinforcing a screen rail of the type having first and second side surfaces and upper and lower portions; wherein said upper portion is curved in the direction of said first side surface; wherein said lower portion includes a leg projecting in the direction of said first side surface; wherein said screen rail includes a plurality of spaced apertures therethrough for receipt of a bolt means having a head; wherein the method comprises (a) securing a metal reinforcement layer to said second side surface of said rail; wherein said reinforcement layer extends substantially along the entire length of said rail; wherein said reinforcement layer includes a plurality of openings therethrough corresponding to said spaced apertures and sized to receive the head of the bolt means; and (b) securing a plurality of reinforcement members to said first side of said rail at the locations of said spaced apertures; wherein each said reinforcement member includes a hole therethrough corresponding to one of said apertures.

8. A method in accordance with claim 7, wherein said reinforcement layer has a thickness in the range of about 0.1 to 0.25 inch.

9. A method in accordance with claim 7, wherein said reinforcement layer is welded to said second side of said rail.

* * * * *